US008529149B2

(12) United States Patent
Yun

(10) Patent No.: US 8,529,149 B2
(45) Date of Patent: Sep. 10, 2013

(54) SPONGE TYPE MAKE-UP BRUSH

(76) Inventor: Jae-Soor Yun, Goyang-si (KR)

( * ) Notice: Subject to any disclaimer, the term of this patent is extended or adjusted under 35 U.S.C. 154(b) by 318 days.

(21) Appl. No.: 12/974,243

(22) Filed: Dec. 21, 2010

(65) Prior Publication Data

US 2011/0146013 A1 Jun. 23, 2011

(30) Foreign Application Priority Data

Dec. 21, 2009 (KR) ..... 10-2009-0128233

(51) Int. Cl.
*B05C 21/00* (2006.01)
*A45D 29/00* (2006.01)
*A45D 40/26* (2006.01)

(52) U.S. Cl.
USPC ..... 401/196; 132/73; 132/320

(58) Field of Classification Search
USPC ..... 401/196, 282; 15/160; 132/73, 132/320; 300/21
See application file for complete search history.

(56) References Cited

U.S. PATENT DOCUMENTS 4,083,078 A * 4/1978 Shimizu ..... 15/244.1
5,806,135 A * 9/1998 Earle ..... 15/244.4
6,026,824 A * 2/2000 Gueret ..... 132/218
6,161,978 A * 12/2000 Dovellos ..... 401/288
6,666,216 B2 * 12/2003 Bourjal ..... 132/320
6,805,510 B2 * 10/2004 Lee ..... 401/200
6,811,340 B2 * 11/2004 Petit ..... 401/122
7,214,336 B2 * 5/2007 Sheridan et al. ..... 264/250
7,284,293 B1 * 10/2007 Holder et al. ..... 15/104.94
7,384,208 B2 * 6/2008 Bouix et al. ..... 401/269
2005/0252824 A1 * 11/2005 Christian ..... 206/581
2008/0017209 A1 * 1/2008 Gueret ..... 132/73
2011/0168198 A1 * 7/2011 Polanish ..... 132/73

* cited by examiner

*Primary Examiner* — David Walczak
*Assistant Examiner* — Jennifer C Chiang
(74) *Attorney, Agent, or Firm* — Sherr & Jiang, PLLC

(57) ABSTRACT

A sponge type make-up brush is provided that comprises a handle part having a sponge-receiving portion and a sponge part having a first portion and a second portion, wherein the second portion of the sponge part has a plurality of coating blades each having cutting surfaces. The plurality coating blades are arranged one after another. A thickness of the coating blades is reduced in a direction away from the handle part. The second portion of the sponge includes a plurality of edge line portions and a plurality of valley portions. The edge line portions are formed where cutting surfaces of a coating blade meet each other and each of the plurality of valley portions is formed where a cutting surface of one coating blade meets a cutting surface of a neighboring coating blade.

12 Claims, 4 Drawing Sheets

SPONGE TYPE MAKE-UP BRUSH

CROSS-REFERENCE TO RELATED APPLICATION

This application claims priority to Korean Patent Application No. 2009-0128233 filed on Dec. 21, 2009, the contents of which are herein incorporated by reference in its entirety.

BACKGROUND

1. Technical Field

Embodiments of the present invention relate to a sponge type make-up brush, and more particularly, to a sponge type make-up brush that includes both a sponge puff and a bristle brush.

2. Discussion of the Related Art

Generally, applicators, such as soft brushes or sponge puffs, are used to apply make-up or apply powder on the skin of an adult or child.

Various types of make-up brushes using animal bristles are disclosed in, for example, Korean Patent No. 530486 (issued on Nov. 16, 2005), Korean Utility Model Registration Nos. 0165482 (issued on Oct. 18, 1999), and 0442172 (issued on Oct. 8, 2008), which are incorporated herein by reference.

The above-mentioned conventional make-up brushes may provide a soft touch to user's skin and may evenly apply a coating material to the user's skin. However, the conventional make-up brushes can be complicated to manufacture, can have high manufacturing costs, and may lose bristles during use.

A make-up sponge puff can be made by processing a sponge that is formed by foaming a material, such as latex or synthetic resin. A handle band may be disposed on a surface of the sponge puff. Conventional functional make-up sponge puffs are disclosed in, for example, Korean Utility Model Registration Nos. 0206069 (issued on Sep. 28, 2000) and 0391389 (issued on Jul. 22, 2005) and Korean Patent Application Laid-open No. 2006-85526 (issued on Jul. 27, 2006), which are incorporated herein by reference.

The above-mentioned conventional make-up sponge puffs may have a relatively simple manufacturing process compared to that of the make-up brushes. However, since a portion contacting user's skin is flat, it may be difficult to continuously retain cosmetics or powder on the make-up sponge and to evenly apply the cosmetics or powder to the user's skin.

As mentioned above, the make-up brushes and the make-up sponge puffs have different characteristics and functions. Portable brushes having both a brush and a sponge are disclosed in, for example, Korean Utility Model Registration No. 262439 (issued on Jan. 16, 2002), which is incorporated herein by reference.

SUMMARY

Embodiments of the present invention provide a sponge type make-up brush that has a brush-shaped sponge part adapted to contact user's skin, thereby providing desirable qualities of both of a brush and a sponge puff.

According to an embodiment of the present invention, there is provided a sponge type make-up brush comprising a handle part having a sponge-receiving portion on a peripheral portion of the handle part, and a sponge part having a first portion press-fittingly inserted into the sponge-receiving portion and a second portion exposed to an outside of the sponge-receiving portion, wherein the second portion of the sponge part includes a plurality of coating blades each having cutting surfaces formed at opposing sides of the cutting blade, wherein the plurality coating blades are arranged one after another and wherein a thickness of each of the coating blades is reduced in a direction away from the handle part, and wherein the second portion of the sponge part includes a plurality of edge line portions and a plurality of valley portions, wherein each of the plurality of edge line portions is formed where two cutting surfaces of a coating blade meet each other and each of the plurality of valley portions is formed where a cutting surface of one coating blade meets a cutting surface of a neighboring coating blade.

According to an embodiment of the present invention, there is provided a method for manufacturing a sponge type make-up brush, comprising press-fittingly inserting a first portion of a sponge part into a sponge receiving portion of a handle part, and exposing a second portion of the sponge part to an outside of the sponge receiving portion, wherein the second portion of the sponge part includes a plurality of coating blades each having cutting surfaces formed at opposing sides of the cutting blade, wherein the plurality coating blades are arranged one after another and wherein a thickness of each of the coating blades is reduced in a direction away from the handle part, and wherein the second portion of the sponge part includes a plurality of edge line portions and a plurality of valley portions, wherein each of the plurality of edge line portions is formed where two cutting surfaces of a coating blade meet each other and each of the plurality of valley portions is formed where a cutting surface of one coating blade meets a cutting surface of a neighboring coating blade.

BRIEF DESCRIPTION OF THE DRAWINGS

The embodiments of the present invention will be apparent from the following detailed description in conjunction with the accompanying drawings, in which.

DESCRIPTION OF THE EMBODIMENTS

Figure 1:
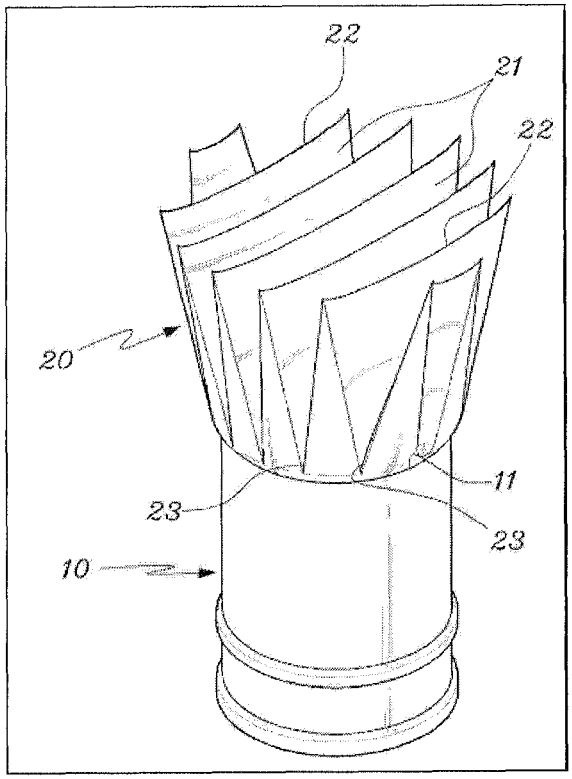
FIG. 1 is a perspective view showing a sponge type make-up brush according to an embodiment of the present invention.

Hereinafter, exemplary embodiments of the present invention will be described in more detail with reference to the accompanying drawings, wherein like reference numerals are used to denote the same or substantially the same elements throughout the specification and the drawings.

Figure 2:
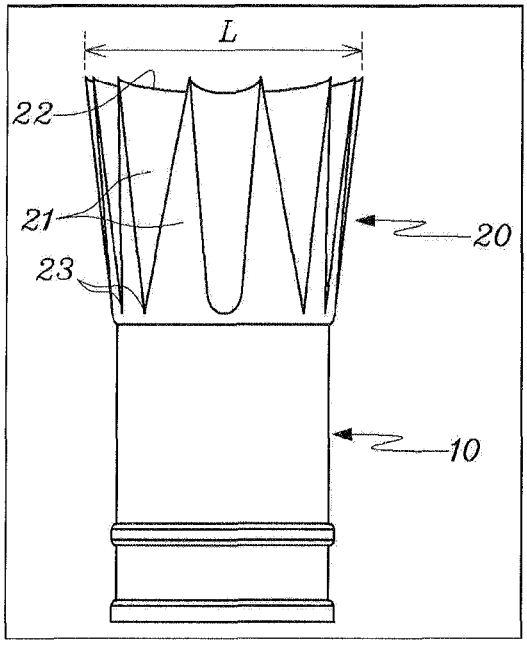
FIG. 2 is a front view of the sponge type make-up brush of FIG. 1.
Figure 3:
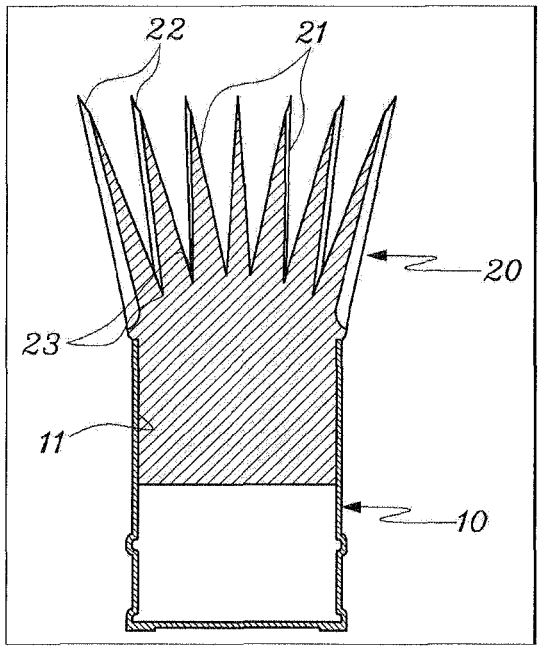
FIG. 3 is a sectional view of the sponge type make-up brush of FIG. 1.

FIG. 1 is a perspective view showing a sponge type make-up brush according to an embodiment of the present invention, FIG. 2 is a front view of the make-up brush of FIG. 1, and FIG. 3 is a sectional view of the make-up brush of FIG. 1.

Referring to FIGS. 1 to 3, a sponge type make-up brush according to an embodiment of the present invention includes a handle part 10 and a sponge part 20.

The handle part 10 includes a sponge-receiving portion 11. The sponge part 20 is inserted into and fixed by the sponge-receiving portion 11. A cross section of the sponge-receiving portion 11 has a shape corresponding to a cross section of the sponge part 20. The handle part 10 is made of plastic, wood, steel, or so on.

The sponge-receiving portion 11 has a smaller size than a size of the sponge part 20 so that the sponge part 20 is press-fittingly inserted into the sponge-receiving portion 11. The sponge part 20 inserted into the sponge-receiving portion 11 may be further fixed to the sponge-receiving portion 11 using an adhesive to prevent the sponge part 20 from being removed from the sponge-receiving portion 11.

The sponge part 20 is formed of a sponge. The sponge part 20 is formed by foaming and molding a material, such as, for example, latex or synthetic resin. According to embodiments, the sponge part 20 may be shaped as a relatively short post whose cross section has a round, oval, square, or polygonal shape.

A portion of the sponge part 20 exposed to the outside of the handle part 10 includes a plurality of coating blades 21 each having cutting surfaces 25 formed at both sides thereof. The plurality of coating blades 21 are arranged one after another. A thickness of each of the plurality of coating blades is reduced as going away from the handle part 10. Each of the coating blades 21 has an edge line portion 22 along which both cutting surfaces 25 thereof meet each other. A V-shaped valley portion 23 is formed where a cutting surface 25 of a coating blade meets a cutting surface 25 of a neighboring coating blade 21.

As shown in FIGS. 1 to 3, the handle part 10 has a cylinder shape, and the sponge part 20 has substantially a cylinder shape. Referring to FIGS. 1 and 2, a length L of an edge line portion 22 is different for one or more of the coating blades.

For example, in a direction toward a middle portion of the sponge part 20, the length L increases, and in a direction away from the middle portion, the length L decreases. A length of a valley portion 23 likewise can vary depending on whether the valley portion is located near or away from a middle portion of the sponge part 20.

Figure 4:
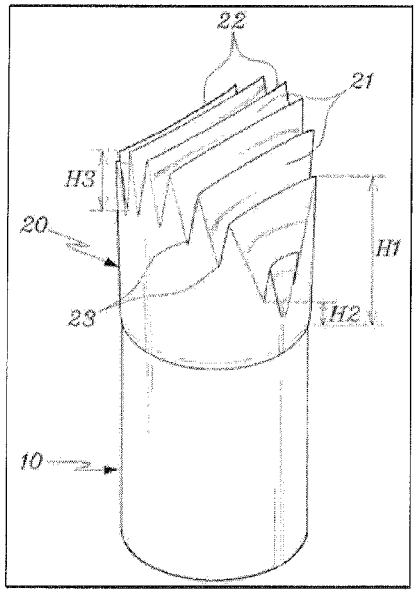
FIG. 4 is a perspective view showing a sponge type make-up brush according to an embodiment of the present invention.

FIG. 4 is a perspective view showing a sponge type make-up brush according to an embodiment of the present invention.

Referring to FIG. 4, "H1" refers to a distance between an edge line portion 22 and an upper portion of the handle part 10, "H2" refers to a distance between a valley portion 23 and the upper portion of the handle part 10, and "H3" refers to a distance between a valley portion 23 and an edge line portion 22 of a coating blade. In a direction toward a middle portion of the sponge part 20, distance H1 increases, and in a direction away from the middle portion of the sponge part 20, distance H1 decreases. Distance H2 also increases and decreases going toward and away from the middle portion of the sponge part 20, respectively. According to an embodiment, distance H2 may be constant irrespective of whether a coating blade is located near or away from the middle portion. Distance H3 is constant regardless of the location of a coating blade.

According to an embodiment, only the distance H1 may be varied according to locations of the coating blades and distance H2 may be constant irrespective of locations of the coating blades. According to an embodiment, distance H3 may be varied according to locations of the coating blades.

The coating blades 21 are formed by cutting a sponge bar whose cross section has a circular or oval shape. Cutting is performed using a cutter having a zigzag-shaped blade. According to an embodiment, the sponge bar may be formed by an extrusion molding process.

Figure 5:
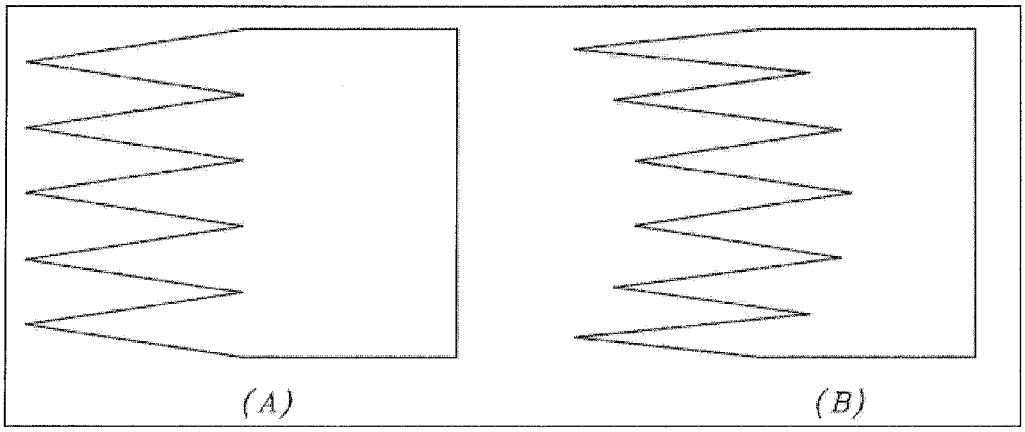
FIGS. 5A and 5B are views schematically showing structures of cutters used for forming coating blades of sponge parts in sponge type make-up brushes according to embodiments of the present invention.

FIGS. 5A and 5B are views schematically showing structures of cutters used for forming the coating blades 21 according to embodiments of the present invention.

When a sponge bar is cut by using a cutter having teeth of the same height as shown in FIG. 5A, coating blades 21 having a constant distance H1 are formed as shown in FIG. 1, and when a sponge bar is cut by using a cutter having teeth of different heights as shown in FIG. 5B, coating blades 21 having different distances H1 are formed as shown in FIG. 4.

The sponge bar includes an elastic body. Thus, the sponge bar is pressed and contracted by the cutter before cutting occurs. As a consequence, the coating blades 21 are formed such that the edge line portions have a rounded shape that is concave when viewed from the front as shown in FIGS. 1 and 2. For example, a distance between the upper portion of the handle part 10 and an edge line portion decreases in a direction toward a middle portion of the edge line portion. Additionally, the coating blades 21 are formed to have a larger thickness in a middle portion of the sponge part 20 than at both side portions of the sponge part 20. As a consequence, tactility, softness, and durability of the sponge part 20 are enhanced.

Figure 6:
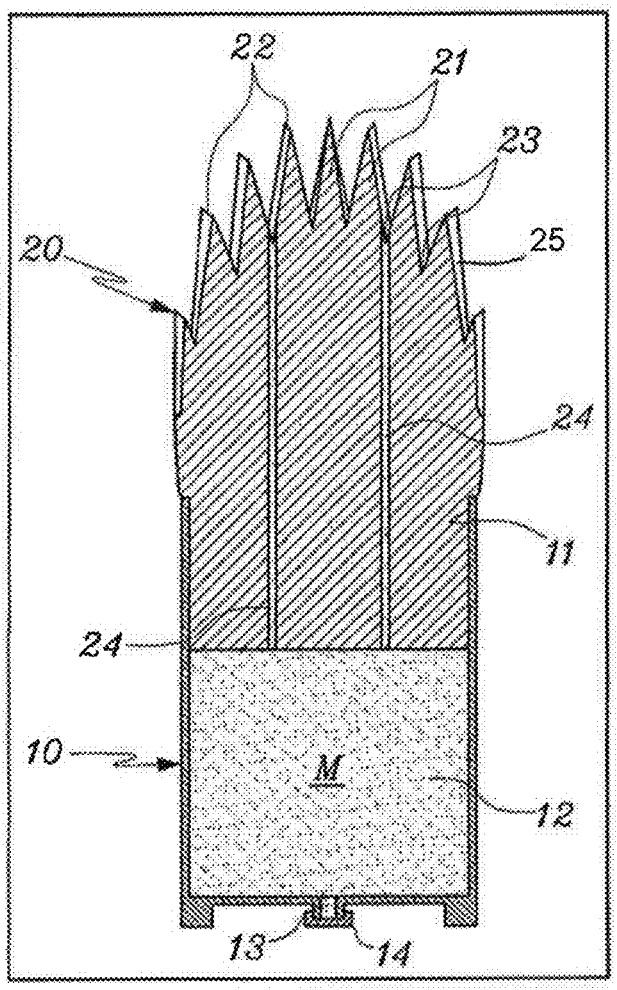
FIG. 6 is a sectional view showing a sponge type make-up brush according to an embodiment of the present invention.

FIG. 6 is a sectional view showing a sponge type make-up brush according to an embodiment of the present invention.

Referring to FIG. 6, the handle part 10 includes a storing portion 12 therein to store a coating material M, such as cosmetics, powder, a medical substance, or the like, and the sponge part 20 includes through-holes 24 passing through the sponge part 20 from the storing portion 12 to the valley portions 23.

The storing portion 12 of the handle part 10 may be formed of a soft material, for example, a soft plastic tube. According to an embodiment, the coating material M may be pushed and discharged from the storing portion 12 via the through holes 24 to the outside of the valley portions 23 by pressing the storing portion 12 with a user's hand, and the discharged coating material M may be applied to a desired site of user's skin by rubbing the skin portion with the coating blades 21.

As shown in FIG. 6, the storing portion 12 includes an inlet portion 13 into which the coating material M is fed and a cap 14 for covering the inlet portion 13 to prevent leakage of the coating material M. According to an embodiment, the handle part 10 may further include a protection cap (not shown) on an upper portion thereof to cover the sponge part 20 so as to protect the sponge part 20 from the outside.

Now, a method for using a sponge type make-up brush according to an embodiment of the present invention will be described.

First, a coating material is coated on the coating blades 21 and is then applied on the user's skin in a direction crossing the edge line portions 22. Since the user's skin is continuously rubbed with the coating blades 21 arranged one after another, the coating material coated on the coating blades 21 is evenly applied on the user's skin.

Further, the coating material remaining in the valley portions 23 between the adjacent coating blades 21 is moved toward the edge line portions 22 and continuously applied on the user's skin while the user's skin is rubbed with the coating blades 21.

The embodiments of the present invention are not limited to the above-described configurations. According to embodiments, the handle part 10 may have additional functions, the sponge part 20 may have other cross-sectional shapes, and the coating blades 21 may have other arrangements.

For example, according to an embodiment, a cap for opening and closing the storing portion 12 may be disposed on the sponge-receiving portion 11 of the handle part 10, and the sponge part 20 may be disposed on the cap for opening and closing the storing portion 12. According to an embodiment, the sponge part 20 may be coated with various antibacterial or aromatic substances.

As set forth in the foregoing, the sponge type make-up brush according to the embodiments of the present invention has the brush-shaped sponge part adapted to contact the user's skin, thereby providing advantages of a bristle brush and a sponge puff.

That is, the sponge type make-up brush according to the embodiments of the present invention provides enhanced tactility and softness to a user's skin, evenly applies a coating material to the user's skin, and prevents loss of bristles during use. Also, the sponge type make-up brush has the storing portion in the handle part so that a coating material may be stored in the storing portion if necessary.

Conventional bristle brushes may be replaced by the sponge type make-up brush according to the embodiments of the present invention for various household or industrial applications, such as applying make-up and powder to skin, or removing hair remaining on skin after a haircut.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A sponge type make-up brush comprising:

a cylindrical-shaped handle part having a sponge-receiving portion extending thru the cylindrical-shaped handle part, the sponge receiving portion located in an inner portion of the cylindrical-shaped handle; and a sponge part having a first portion press-fittingly inserted into the sponge receiving portion and a second portion exposed to an outside of the sponge-receiving portion, the second portion of the sponge part comprising i) a plurality of coating blades, ii) a plurality of edge line portions, and iii) a plurality of valley portions, wherein each of the coating blades has two cutting surfaces which one end of the first cutting surface forms a horizontal edge line portion with one end of the second cutting surface, and the other end of the first cutting surface forms a valley portion with one end of a cutting surface from a neighboring coating blade, wherein the plurality of coating blades are arranged parallel to each other, and wherein a thickness of each of the coating blades is gradually reduced in a direction toward a tip of each said coating blade resulting in a substantially triangular shape.

2. The sponge type make-up brush according to claim 1, wherein a distance (H1) between the horizontal edge line portion and an upper portion of the cylindrical-shaped handle part increases in a direction toward a middle portion located along a cross section of the sponge part.

3. The sponge type make-up brush according to claim 1, wherein the cylindrical-shaped handle part includes a storing portion therein, and the sponge part includes through-holes passing through the sponge part from the storing portion to the valley portion.

4. The sponge type make-up brush according to claim 2, wherein the cylindrical-shaped handle part includes a storing portion therein, and the sponge part includes through-holes passing through the sponge part from the storing portion to the valley portion.

5. The sponge type make-up brush according to claim 3, wherein the storing portion of the cylindrical-shaped handle part is formed of a soft material.

6. The sponge type make-up brush according to claim 1, wherein the horizontal edge line portion has a concave shape that is concave as viewed from a front.

7. The sponge type make-up brush according to claim 1, wherein a distance (H3) between the horizontal edge line portion and the valley portion is constant irrespective of locations of the coating blades.

8. The sponge type make-up brush according to claim 1, wherein a distance (H2) between the valley portion and an upper portion of the cylindrical-shaped handle part increases in a direction toward a middle portion located along a cross section of the sponge part.

9. The sponge type make-up brush according to claim 1, wherein a distance (H2) between the valley portion and an upper portion of the cylindrical-shaped handle part is constant irrespective of locations of the coating blades.

10. The sponge type make-up brush according to claim 1, wherein a length of the horizontal edge line portions increases in a direction toward a middle portion located along a cross section of the sponge part.

11. A method for manufacturing a sponge type make-up brush comprising:

press-fittingly inserting a first portion of a sponge part into a sponge-receiving portion located in an inner portion of a cylindrical-shaped handle part; and exposing a second portion of the sponge part to an outside of the sponge-receiving portion, the second portion of the sponge part comprising i) a plurality of coating blades, ii) a plurality of edge line portions, and iii) a plurality of valley portions, wherein each of the coating blades has two cutting surfaces which one end of the first cutting surface forms a horizontal edge line portion with one end of the second cutting surface, and the other end of the first cutting surface forms a valley portion with one end of a cutting surface from a neighboring coating blade, wherein the plurality of coating blades are arranged parallel to each other and wherein a thickness of each of the coating blades is gradually reduced in a direction toward a tip of each said coating blade resulting in a substantially triangular shape.

12. The method of claim 11, wherein the coating blades are made by cutting a sponge bar whose cross section has a circular or oval shape using a cutter having a zigzag-shaped blade.

* * * * *